United States Patent [19]

Shreiner et al.

[11] Patent Number: 4,866,896

[45] Date of Patent: Sep. 19, 1989

[54] PANEL WALL SYSTEM

[75] Inventors: Thomas A. Shreiner, Muncy, Pa.; William W. Vincent, Ontario, Canada; Robert W. Olsen, Mendham, N.J.

[73] Assignee: Construction Specialties, Inc., Cranford, N.J.

[21] Appl. No.: 186,373

[22] Filed: Apr. 26, 1988

[51] Int. Cl.[4] ..... E04B 2/88; E04H 1/00

[52] U.S. Cl. ..... 52/235; 52/403

[58] Field of Search ..... 52/235, 403, 508, 511, 52/204, 533

[56] References Cited

U.S. PATENT DOCUMENTS

| | | | |
|---|---|---|---|
| 4,307,551 | 12/1981 | Crandell | 52/235 |
| 4,543,755 | 10/1985 | Crandell | 52/475 |
| 4,685,263 | 8/1987 | Ting | 52/511 |

*Primary Examiner*—James L. Ridgill, Jr.

*Attorney, Agent, or Firm*—Brumbaugh, Graves, Donohue & Raymond

[57] ABSTRACT

A panel wall system is composed of a multiplicity of rectangular panels arranged in closely spaced relation in columns and rows such as to define vertical junctures between horizontally adjacent panels and horizontal junctures between vertically adjacent panels and affixed at their upper edges to horizontal support members by mounting clips and joined at each vertical juncture to a vertically continuous vertical track member. Each panel has a peripheral frame composed of a top member, a bottom member and a pair of side members joined at the respective corners and a facing of sheet material adhesively bonded to the frame. A seal is formed along each horizontal juncture by a horizontal gasket on the bottom frame member of the panel above the juncture that engages a flange on the top frame member of the panel below the juncture. A seal is formed at each vertical juncture by vertical gaskets on the vertical track that engage the respective side members of the panels on either side of the juncture. Each frame member of each panel has a continuous rear flange portion of generally L-shaped cross-section defining a recess that opens outwardly toward the perimeter of the panel, the ends of the flange portions meeting adjacent the corners of the panels so as to form a continuous water drainage channel and spray trap at the panel perimeter. The bottom and end recesses also constitute parts of slip joints, the other parts of which are a flange on the top frame member of a vertically adjacent panel, a bottom closure or a flange on a vertical track.

17 Claims, 13 Drawing Sheets

PANEL WALL SYSTEM

BACKGROUND OF THE INVENTION

There are, of course, many ways of finishing the exteriors of commercial and industrial buildings. One type of external wall system utilizes individual prefabricated panels that are suitably fastened to the building framing, ordinarily by a relatively light-weight retaining system to which the panels can readily be attached and by which the panels are joined to the main building framing. Within this general type of exterior panel wall system are some commercially available versions that utilize composite panels composed of thin aluminum sheets laminated to a plastic core. These composite panels fit into a frame work made up of retainers having grooves that receive the edges of the panels.

These previously known panel systems based on aluminum/plastic/aluminum composite panels have several disadvantages. For one thing, the framing system ordinarily requires that the panels and retainers be installed in step, panel by panel and retainer by retainer, working horizontally and vertically, inasmuch as the system depends upon reception of the panel edges in channels or tracks of the retainers. Thus, after a panel is installed, the retainer tracks for the then free edges of the panel are installed and so forth. As far as installation costs are concerned, the assembly procedure is relatively inexpensive and can be accomplished relatively quickly. On the other hand, there is a distinct disadvantage that any panels that might be damaged during the life of the building are difficult to replace. Moreover, the composite panels have shown a tendency to delaminate because of deterioration of the adhesives due to the effect of moisture that attacks the edges where they fit into the retainers.

Several years ago, Construction Specialties, Inc. the assignee of the present invention, developed and commercialized a panel wall system under the trademark "Tech Wall®" that has numerous advantages. While there are now several versions of the "Tech Wall®" panel wall system, they share the common concept of fastening shallow pan-like panels to horizontal and vertical retainers. Reference may be made to U.S. Pat. Nos. 4,622,794 (Goertner, Nov. 18, 1986) 4,506,484 (Bartlett et al., Mar. 26, 1985), 4,597,235 (Olsen, July 1, 1986) and 4,607,471 (Olsen, Aug. 26, 1986) for detailed descriptions and illustrations of the previously known (and "prior art") "Tech Wall®" panel wall systems.

Among the advantages of the "Tech Wall®" systems are a high degree of design flexibility in the architectural uses, a variety of joint systems, the durability of the panels, and the ability to replace damaged panels by removing only the damaged one or small groups of panels including the damaged one. The system of the Goertner patent, for example, uses T-shaped clips that fit into slots in the panel flanges to fasten the panels individually to the framing system and an adhesive sealant to seal all joints. The Bartlett et al. patent and the Olsen '235 patent describe and show arrangements of water control troughs and channels for trapping any water that intrudes through the seals (which is not unexpected after numerous thermal cycles) or that condenses behind the panels and directing it outside. The Olsen '471 patent discloses a relatively simple, low-cost version designed for use with the "rain screen" principle of curtain wall design, in which an exterior back-up sheathing wall is well-sealed, the curtain wall is designed to minimize but not always stop water intrusion, and the space between the sheathing wall and curtain wall is drained and well-ventilated to the outside to provide pressure equalization across the curtain wall. The pressure equalization limits water intrusion into the air space between the sheathing wall and curtain wall.

SUMMARY OF THE INVENTION

An object of the present invention is to provide a wall panel system that is lighter in weight and lower in cost than the prior "Tech Wall®" systems. Another object is to provide an effective sealing arrangement in the panel wall with minimal use of field-placed caulking—the sealing arrangement can be termed a "dry seal." Yet a further object is to provide greater architectural versatility and enhanced appearance. For example, the panel system of the present invention integrates easily with other wall systems and can itself use panel members of different materials. Also, with the preferred panel facing materials, such as sheets of aluminum coil stock, the panel members are flatter than those of the prior "Tech Wall®" systems. The present invention carries forward the advantages of ease of field erection and the ability to replace damaged panels by removing only the damaged panel and any panels vertically above the damaged one in a vertical panel array. The present invention also includes water drainage features of the known "Tech Wall®" versions.

The foregoing objects are attained, according to the present invention, by a wall panel system that, like the prior "Tech Wall®" systems, is composed of a multiplicity of rectangular panels arranged in closely spaced relation in columns and rows such as to define vertical junctures between horizontally adjacent panels and horizontal junctures between vertically adjacent panels and affixed to horizontal support members and vertical track members. The present invention is characterized in that each panel has a peripheral frame composed of a top member, a bottom member and a pair of side members joined at the respective corners and a facing of sheet material adhesively bonded to the frame, in that a seal is formed along each horizontal juncture by a horizontal gasket on the bottom frame member of the panel above such juncture that engages a flange on the top frame member of the panel below the juncture, and in that a seal is formed at each vertical juncture by vertical gaskets on the vertical track that engage the respective side members of the panels on either side of the juncture.

Preferred embodiments of the invention are further characterized by one or more of the following features, alone or in combination:

(1) Each frame member of each panel has a continuous rear flange portion of generally L-shaped cross-section defining a recess that opens outwardly toward the perimeter of the panel, and the ends of the flange portions meet adjacent the corners of the panels so as to form a continuous water trap at the panel perimeter.

(2) The recess referred to in (1) above that is defined by the rear flange portion of each bottom frame member of each panel above a horizontal juncture forms a slip joint with an upwardly extending front leg on each of the mounting clips by which the panel below that juncture is fastened to the horizontal support.

(3) The recess referred to in (1) above that is defined by the rear flange portion of each side member of each panel adjacent a vertical juncture forms a slip joint with a front flange portion of the vertical track.

(4) The recess of paragraph (3) of each side member of each panel has a depth in the horizontal direction sufficient to permit the panel to be slided horizontally in one direction toward the vertical track at one side to form one slip joint and leave clearance at the vertical track at the other side for acceptance of the panel and formation of the other slip joint upon sliding the panel in the other direction.

(5) The top frame member of each panel below a horizontal juncture includes an attachment rib portion that receives the mounting clips. The centermost mounting clip is affixed to the attachment rib portion against horizontal movement, and all other clips are slidable longitudinally so as to allow differential thermal expansion and contraction of the panel relative to the horizontal support member (6) The clips are segments of an extruded aluminum member of generally J-shaped cross-section having a longer rear leg, a shorter front leg and an undercut slot adjacent the lower edge of the front leg receiving the attachment rib portion of the top frame member.

(7) Each bottom frame member of each panel above a horizontal juncture has a continuous flange of generally L-shaped cross-section defining a recess that opens outwardly toward the bottom edge of the panel and forms a slip joint with the front leg of the clip.

(8) Each horizontal support member at a horizontal juncture is located above the juncture so that it can accept fasteners passed through the rear leg of the clip at locations above the upper end of the front leg of the clip.

(9) The horizontal support members for a wall section having a multiplicity of horizontally adjacent panels extend across the vertical junctures, and the vertical track members are fastened to the horizontal support members.

(10) The vertical track members have a rear flange portion that extends laterally outwardly on either side of the vertical juncture and serves as a barrier to trap any water that penetrates the vertical gaskets and a drainage path for such trapped water to the bottom of a wall section.

(11) Each panel frame member has a substantially uniform cross-section along its length and includes in cross-section a base leg spaced-apart rearwardly from the facing, lying parallel to the facing and extending inwardly from the perimeter of the facing such as to underlie a portion of the facing, and an L-shaped front flange having a first leg joined to the base leg and forming the edge of the panel and a second leg joined to the first leg and adhesively bonded to a band along the edge of the back surface of the facing, such as by a double-faced industrial adhesive tape. There is also a substantially continuous adhesive bond between the base leg of each frame member and a band along the back surface of the facing spaced apart from the corresponding edge of the facing.

(12) Each panel includes at least one stiffener member extending between and fastened to opposite frame members of the panel and adhesively bonded to the back surface of the facing.

For a better understanding of the present invention, reference may be made to the following description of exemplary embodiments, taken in conjunction with the figures of the accompanying drawings.

DESCRIPTION OF THE DRAWINGS

FIG. 4—3C-3;
FIG. 5—3C-4;
FIG. 6—3C-5;
FIG. 7—3C-11;
FIG. 8—3C-15;
FIG. 9—3C-16;
FIG. 10—3C-17;
FIG. 11—3C-18;
FIG. 12—3C-19;
FIG. 13—3C-20;
FIG. 14—3C-6;
FIG. 15—3C-9;
FIG. 16—3C-7;
FIG. 17—3C-8;
FIG. 18—3C-10;
FIG. 19—3C-13;
FIG. 20—3C-12; and
FIG. 21—3C-14.

DESCRIPTION OF THE EMBODIMENT The perspective view of a typical building is included, first, to indicate the locations of the details of FIGS. 4 to 21 and, second, to illustrate the wide variety of panel arrangements afforded by the system. The building comprises two stories, each having rows of side-by-side windows 10. At the corner in the foreground, the ground floor is set in to leave an overhang for a covered walkway to the entrance doors 12. The corner of the building above the walkway has radiused external corner panels 14. The remainder of the facade (except for inside and outside corners) is composed of planar panels 16 arranged in vertical columnar sections and horizontal rows. FIG. 1 also shows a juncture between the panel system of the invention and a wall of another type, such as a brick wall 18.

FIG. 2 shows the main components of the panel system. As described below, those components vary in design, depending on architectural conditions, but the various versions of each component share some common characteristics. One such characteristic is that each panel P forms a juncture at each end with a vertical track VT, is supported along its upper edge by a horizontal member HM and forms a juncture along its lower edge with either a bottom closure member CM or another panel P. In any wall section composed of two or more panels P in a vertical column, the vertical tracks VT are coextensive vertically with all panels in that column. Generally, though not necessarily, panels of the same height are used in horizontal rows such as to form continuous, straight horizontal junctures with other rows of panels P, windows 10, bottom closure members CM, soffits, coping and the like. Another common feature of the system is that the horizontal members HM are affixed to the building wall (as described below), and the vertical tracks VT are affixed to the horizontal members HM (also as described below). At each vertical juncture between the end of a panel P and a vertical track there is a seal formed by a vertical gasket in the vertical track. Also, a seal is formed at each horizontal juncture between vertically adjacent panels P by a horizontal gasket adjacent the bottom edge of the panel above the juncture that engages a flange on the upper edge of the panel below the juncture.

It is intended that the term "horizontal member", as used herein, be interpreted broadly to include any horizontal support element for the upper edge or a panel or panels. In most cases, the "horizontal member" will be a hat or similar rail-like member affixed to elements of a backup wall (most often metal studs). It is entirely feasible, however, to install the panel system on a back-up wall, such as a brick or concrete wall, by fastening the upper edges of the panels and the vertical tracks directly to the back-up wall. Such a back-up wall functions as a "horizontal member".

Each panel P is composed of a peripheral frame fabricated from a pair of side members, a top member and a bottom member joined at their respective corners and a facing of sheet material adhesively bonded to the frame. The specific designs of the frame members vary according to the architectural conditions, as described below, but several common characteristics are found in all panels, also as described below.

The panels may be up to 15'-0" in length and from 1'-0" to 5'-0" in height. Larger-sized panels have stiffener channels (34, FIG. 3) suitably fastened to the top and bottom frame members and adhesively joined to the facing. The greater the height of the panels, the closer the spacing of the stiffener channels. For panels up to 2'-0" in height a spacing of 48" is suitable; for 5'-0" panels the channels should be 24" on centers.

Figure 3:
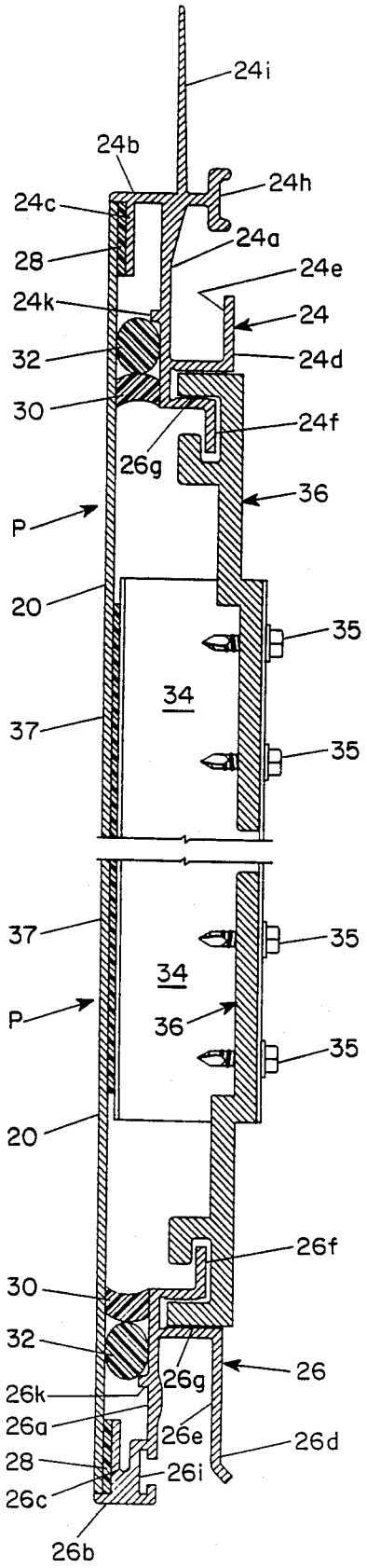
FIG. 3 is a side cross-sectional view of a panel member of the system.
Figure 4:
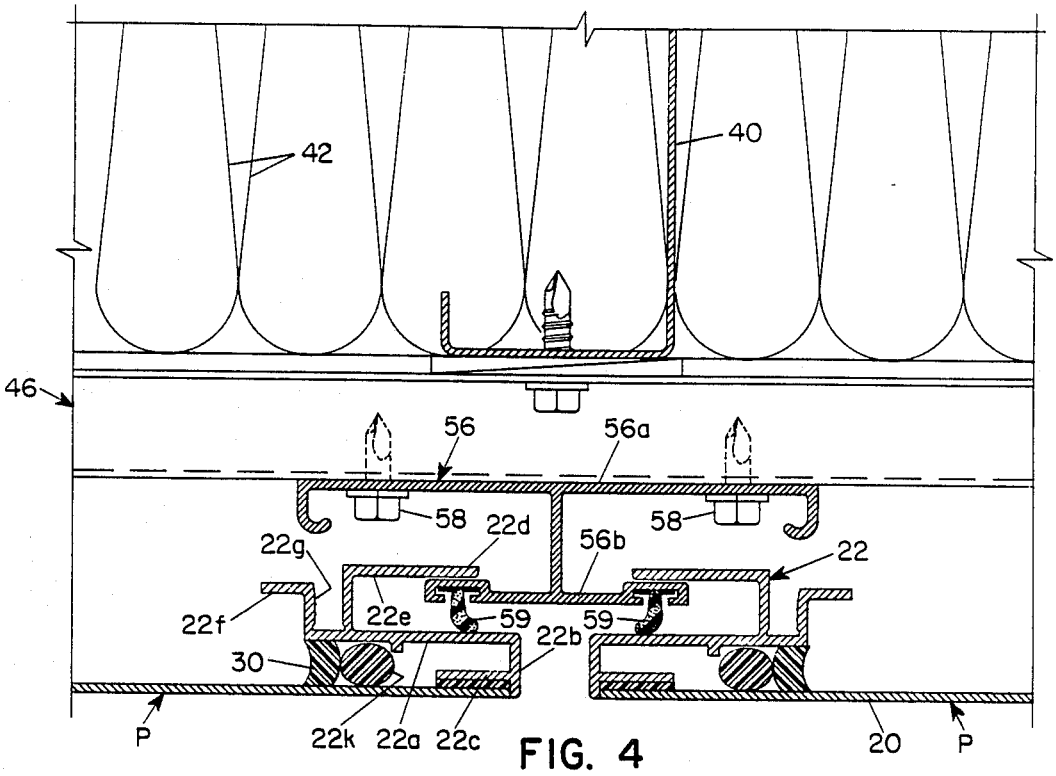
FIGS. 4 to 21, inclusive, are fragmentary detail cross-sectional views taken at locations indicated by labelled, arrowed lines in FIG. 1, as follows.
Figure 5:
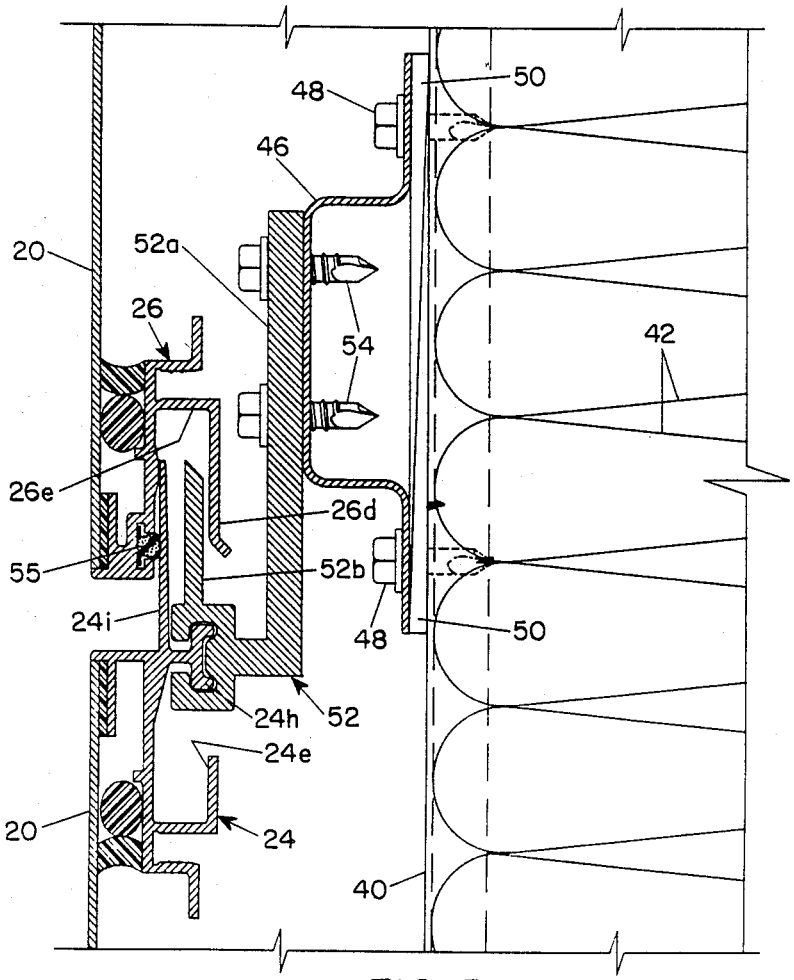

In most buildings in which the present system is used, the most prevalent panel design is one that forms horizontal and vertical junctures with adjacent panels. Such a panel, as shown in FIGS. 3, 4 and 5, consists of a facing 20 of sheet material, identical side frame members 22, a top frame member 24 and a bottom frame member 26. The sheet material facing 20 may be precoated aluminum coil stock of, for example, a thickness of 0.063 inch, stainless steel, fiberglass, plastic, artificial marble and other suitable durable sheet materials. The frame members are pieces cut from extruded aluminum.

Each side frame member 22 (FIG. 4) includes, in cross-section, a base leg portion **22*a*, an edge portion 22*b*, a front flange portion 22*c* and a rear flange portion 22*d* of generally L-shape defining a recess 22*e* that opens outwardly toward the perimeter of the panel. A second L-shaped flange portion 22*f* at the inner edge of the base leg portion 22*a* defines a groove 22*g*. The top frame member 24 (FIGS. 3 and 5) comprises a base leg portion 24*a*, and edge portion 24*b*, a front flange portion 24*c*, an L-shaped rear flange portion 24*d* forming an outwardly open recess 24*e* and a second L-shaped flange portion 24*f* defining a groove 24*g*, these portions being counterparts of the portions 22*a* to 22*g* of the side frame members 22. In addition, a T-shaped attachment rib 24*h* extends rearwardly from the base leg, and an upwardly extending leg 24*i* projects from the edge portion 24*b* in a plane parallel to the facing 20. The bottom frame member 26 (FIGS. 3 and 5) has portions corresponding to those of the side and top frame members, which are likewise designated by the letters a to g, and further includes a T-shaped groove 26*j* (for the gasket described below). The frame members are joined at mitered joints at the corners by solid aluminum right-angle clips (not shown) that are force fit in the respective grooves 22*g*, 24*g* and 26*g***.

The front flanges **22*c*, 24*c* and 26*c* of the frame members present land areas for a continuous band along the edge of the facing 20. The facing 20 is adhesively bonded to the front flanges of the frame members by a double-faced industrial adhesive tape 28. The facing is inset in the frame, in that a bead along the front of the edge portion (22*b*, 24*b*, 26*b*) of the frame is contiguous to the exterior surface; the chance of loosening of the bond along the facing edge is virtually nil. The primary structural bond between the facing 20 and the frame of each panel is provided by a silicone structural adhesive 30 applied along the entire extent of the frame in a cavity between the facing and the base leg portions of the frame members formed by a backer rod 32. The location of the backer rod 32 is established by a rib portion 22*k*, 24*k*, 26*k*** of each frame member.

Where required, vertical stiffener channels 34 (FIG. 3), which are located at suitable horizontal spacings along the panel (as described above), are joined to the top and bottom frame members by brackets 36 that hook onto the flange portions **24*f* and 26*f* and are fastened to the channels 34 by self-tapping, self-threading Teks TM screws 35. All stiffener channels are adhesively bonded to the facing 20, for example, by a double-faced industrial adhesive tape 37**. The panels are very rigid and yet relatively light in weight. The facings retain a high degree of flatness.

Figure 2:
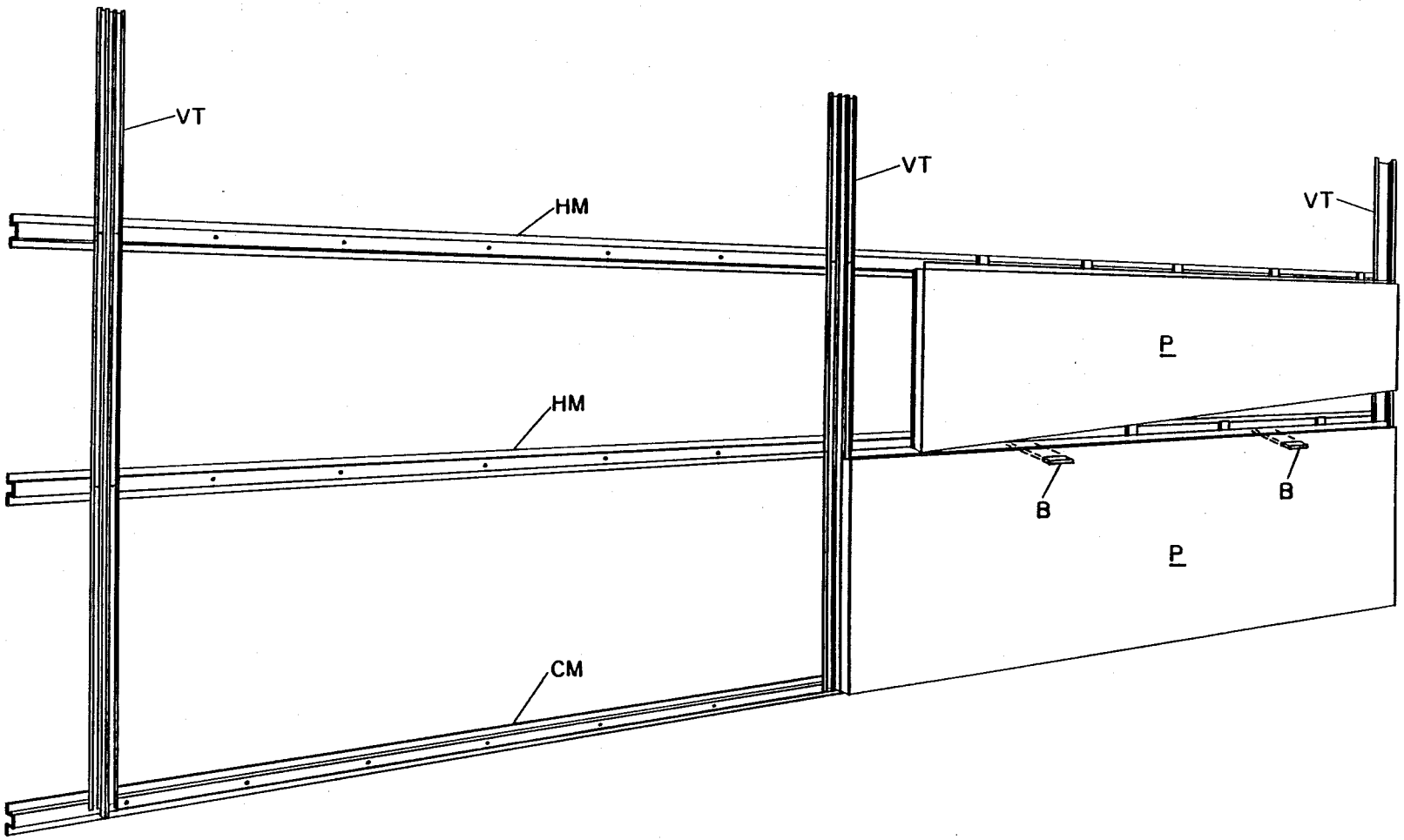
FIG. 2 is a perspective view of a typical section of the system, shows the main components and illustrates how the system is erected.
Figure 7:
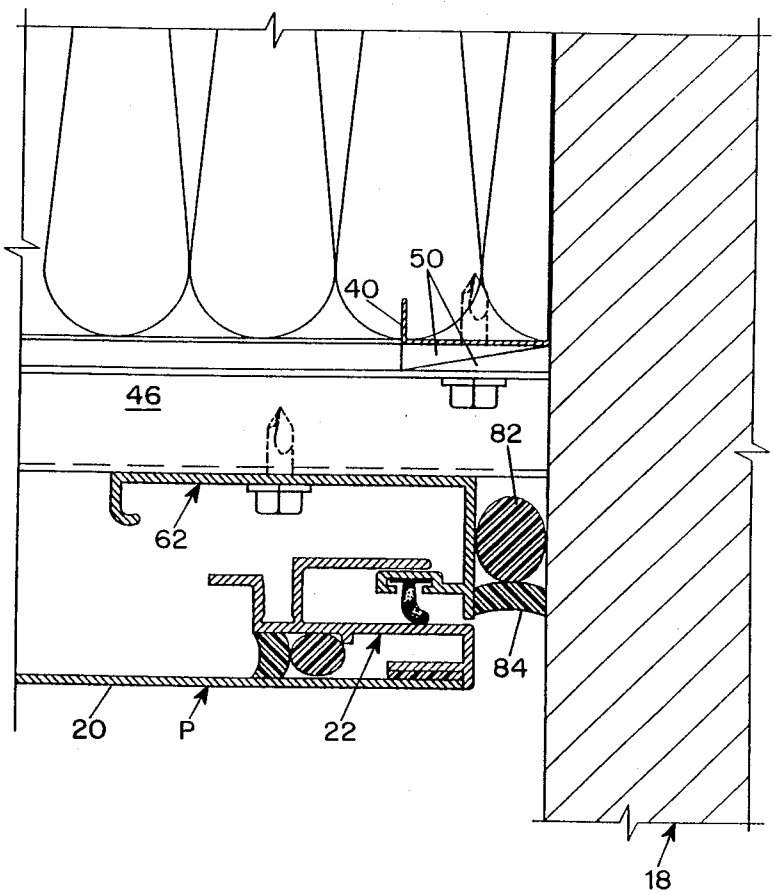
Figure 8:
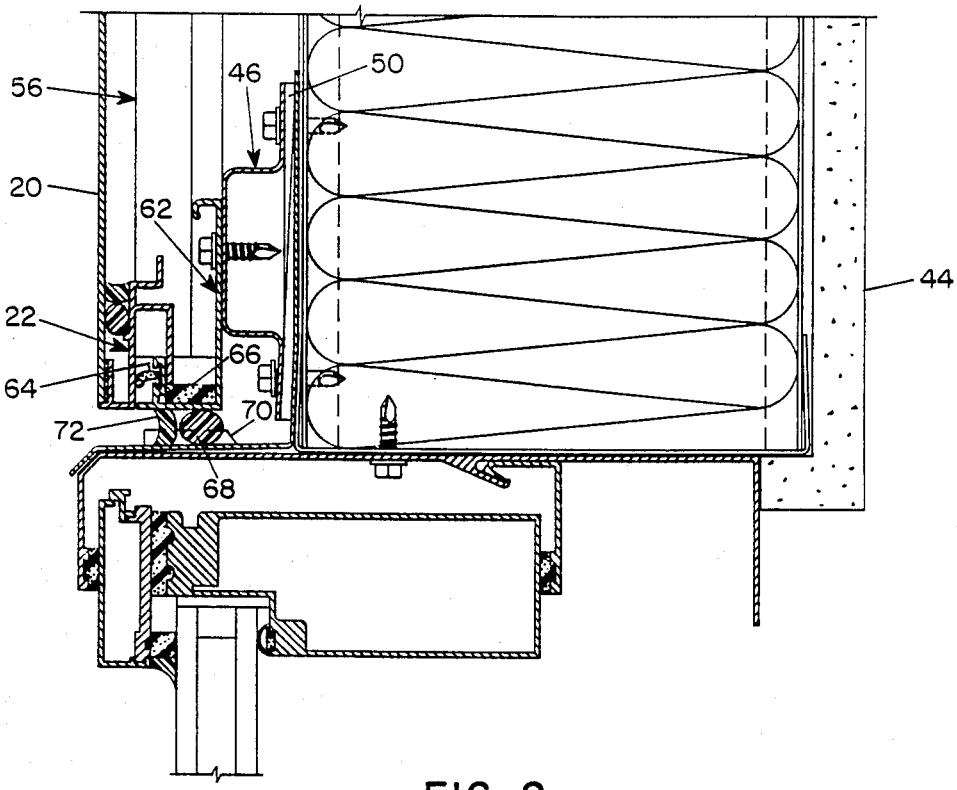

All of the detail drawings (FIGS. 4 to 21) show the panel system of the invention installed on a conventional structural wall based on steel studs 40, exterior wall insulation 42 and interior gypsum wall board 44 (see, e.g., FIG. 8). If desired or required, the wall system can be applied over exterior sheathing. The system can also be used with other types of back-up wall construction with suitable fastening systems for the horizontal members HM. At each horizontal juncture between adjacent panels, the horizontal member HM (FIG. 2) for the panel below that juncture is a hat 46 (FIG. 5) that is fastened to the studs 40 above the top edge of the panel using Teks TM screws 48 and shims 50. Aluminum clips 52, made by cutting pieces (e.g., 2 in. wide) from an extrusion, are installed at intervals (e.g., 16 in.) on the attachment rib **24*h* of the panel below the hat 46. The centermost clip 52 is crimped or otherwise fastened to the rib 24*h*, but all other clips 52 on each panel are received by the rib 24*h* with a sliding fit to permit thermal expansion and contraction of the panel relative to the back-up wall in both directions relative to the center. The base legs 52*a* of all of the clips 52 on the panel are fastened to the hat 46 by Teks TM screws 54**.

The lower edge of each panel above a horizontal juncture between panels is held by a slip joint between the leg **24*i* of the top frame member 24 of the panel below that juncture, a vertical leg portion 52*b* of each clip 52 from which the panel below that juncture is suspended, and the recess 26*e* of the bottom frame member 26 of the panel above that juncture (see FIG. 5). The slip joint bears no vertical load but supports positive and negative loads perpendicular to the wall. A continuous horizontal gasket 55 installed in the groove 26*j* bears against the face of the leg 24*i*** and forms a horizontal dry seal between the edges of two panels at the horizontal juncture.

At each vertical juncture between adjacent panels (FIG. 4) is a vertical track 56 that extends the full height of each vertical column of adjacent panels. The track 56 is fastened to the hats 46 by Teks TM screws 58 received through its rear flange portion 56a. Each leg of the front flange portion 56b of the track forms a slip joint with the respective recess 22e of the panel frame member on either side of the joint. A vertical gasket 59 that extends continuously the full height of the track 56 and is retained in a slot in the front flange 56b forms a dry seal with the base portion 22a at each slip joint between the track 56 and the panel. Each vertical gasket also forms a seal with the back surface of the leg portion 24i of the top frame member 24 of each panel. The rib portion 24h of the top frame member 24 is cut away at each end of the panel to allow the base portion 24a and leg portion 24i to engage the vertical gasket 59 and, of course, to permit the slip joints at the panel ends to be formed. Because of the mitered joints between the frame members, parts of the rear flange portions 24d and 26d of the top and bottom frame members are cut away (when the miter cuts are made) and do not interfere with the slip joints at each end of the panel. In summary then, vertically adjacent panels are sealed to each other at their horizontal junctures by the horizontal gaskets 55, and each panel (or column of panels) is sealed continuously along its vertical extent at each end to the vertical track by a vertical gasket 59.

Figure 6:
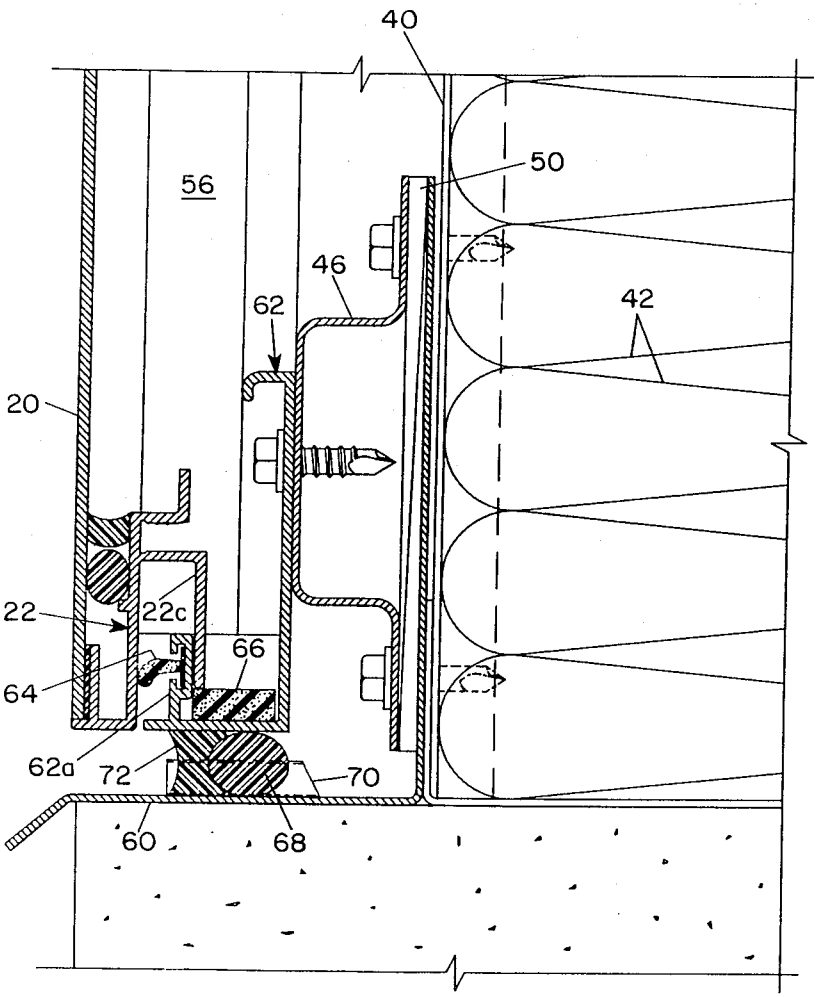

FIG. 6 shows the arrangement of a panel juncture with a sill (where the bottom edge of the lowest panel meets the building foundation). For the bottom frame member of the panel in this condition, the side frame member section 22 (see FIG. 4) is used in place of the bottom frame member section 26. In all other respects, the panel is the same as those described above. A hat 46 is fastened to the studs over flashing 60 and shims 50. A continuous closure member 62, which extends between the vertical tracks VT (e.g., 56), is fastened by Teks TM screws to the hat. A flange portion 62a carrying a continuous horizontal gasket 64 forms a slip joint and a seal with the recess 22e of the frame member 22. Neoprene blocks 66 serve as spacers to establish a gap between the bottom edge of the panel and the sill but yield to allow for thermal expansion of the panel. Temporary blocks (not shown, but see blocks B in FIG. 2) placed on the sill in front of the closure member 62 can be used instead of the blocks 66 to set up the bottom panel. A backer rod 68 and some drain tubes 70 are installed in the gap between the panel and the sill, and the gap is sealed with caulking 72.

Referring again to FIG. 2, the erection procedure begins with the installation of the horizontal members HM, which are carefully measured, levelled and shimmed along the full length and height of a panel wall section. The vertical tracks VT on either side of a vertical column of panels P and the bottom closure member BC are installed. The slip joints at the ends of the panels are deep enough to allow the slip joint at one panel end to be fitted to the vertical track at that end by skewing the other panel end out slightly. The other end of the panel is then pushed in toward the backup wall. The panel is elevated above its final position up to this point to clear the bottom slip joint and can now be lowered to form the slip joint with the bottom closure flange 62a. The panel is blocked at the bottom to provide the desired gap at the sill. The panel is then moved endwise to form the other slip joint and to center it between the vertical tracks, and the clips 52 at its upper end are fastened to the hat 46. The center clip holds the panel in position endwise, as described above. The panel hangs from the clips but is otherwise essentially unrestrained in the plane of the wall. The clips and slip joints carry loads orthogonal to the wall. The slip joints have clearances between the metal elements to allow loading the gaskets. Positive wind loads produce small displacements of the panels toward the backup wall, which actually enhances the dry seals formed by the gaskets.

Intermediate panels in vertical columns of panels are installed in the same way as the bottom panel (fitting the slip joint at one end with the panel skewed to the plane of the wall and elevated to clear the bottom slip joint, dropping the panel down on temporary blocks (B in FIG. 2) to form the bottom slip joint, centering the panel to form the other end slip joint and fastening the clips to the hats).

The panels can be removed by reversing the steps of the installation procedure. If a panel should be damaged, only the damaged one and any panels above it in the same vertical columnar section need be removed.

Figure 1:
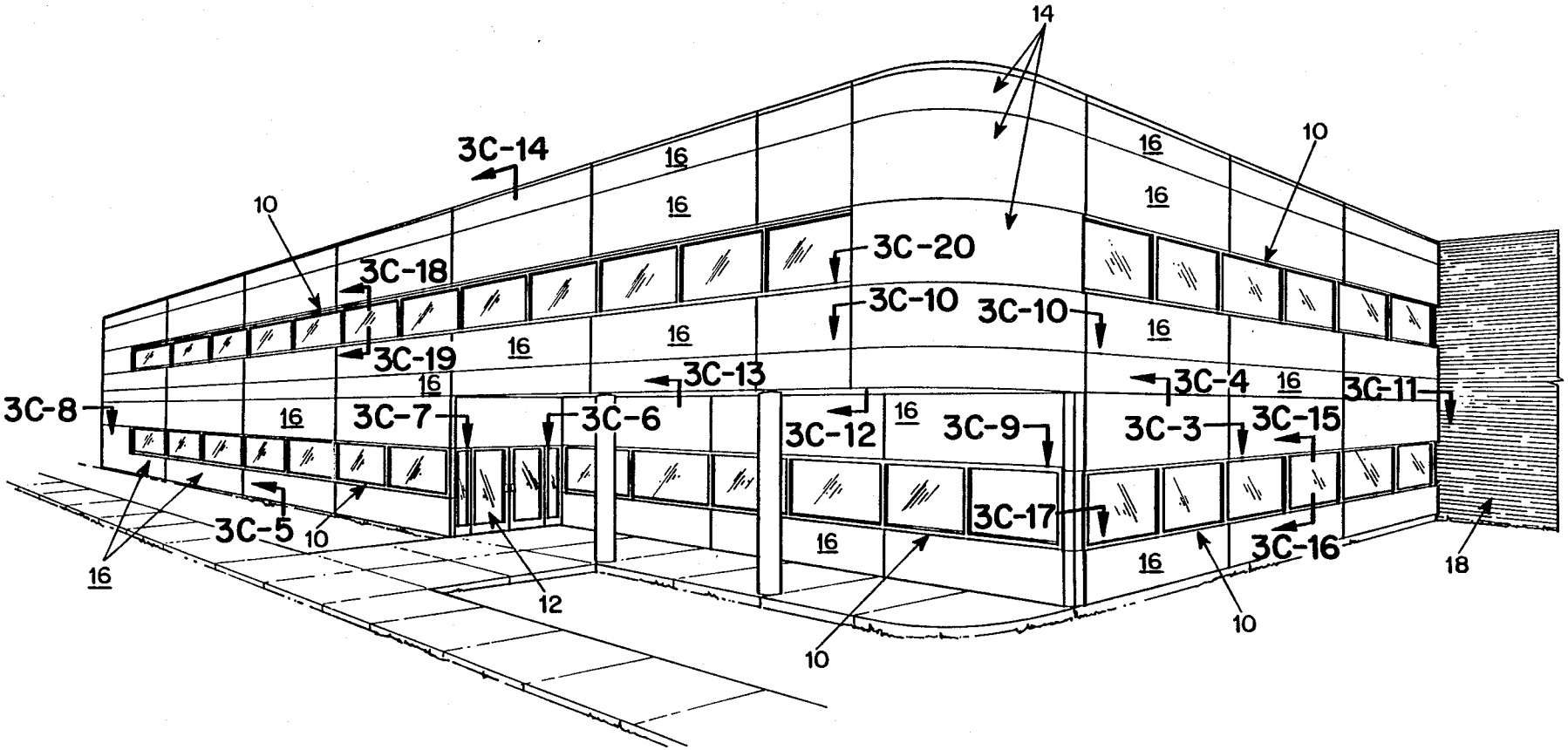
FIG. 1 is a perspective view of a typical building that incorporates a panel wall system according to the present invention.

FIG. 7 shows the treatment of a vertical juncture between a panel wall section and a wall 18 (see FIG. 1) of a different type. The only differences between the treatment of FIG. 7 and that of FIG. 4 (vertical juncture between panels) are that the vertical track VT is a length of the same extrusion as is used for the bottom closure 62 (see FIG. 6), and the joint is sealed with a backer rod 82 and sealant 84.

FIG. 8 shows the condition at the head of a flush-installed window—it is exactly the same as the condition at a sill, as shown in FIG. 6, and need not, therefore, be described.

Figure 9:
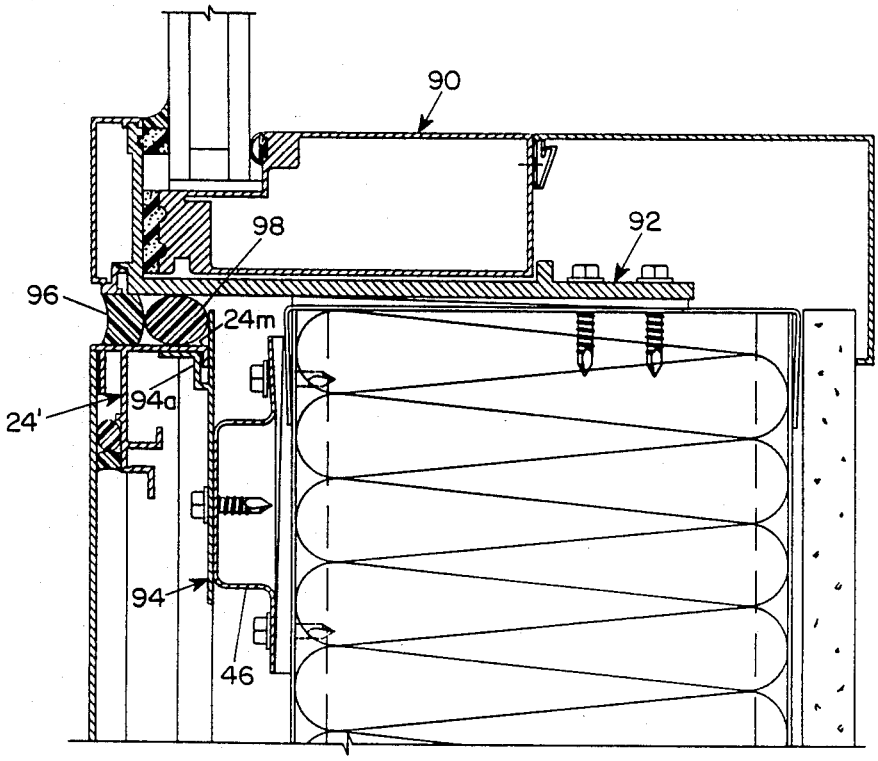

A common upper terminus of a panel or vertical column of panels P is at a window sill. As shown in FIG. 9, a typical flush window assembly 90 rests on a base plate 92 that in turn rests on the stud backup wall. A hat 46 is fastened by Teks TM screws to the studs, and to it is fastened a continuous top closure 94 that includes a flange portion 94a having a groove for receiving a mounting flange portion 24m of a panel top frame member 24'. The top frame member 24' is similar to the top frame members 24 of the bottom and intermediate panels of a vertical array except that it has the flange portion 24m and does not have the leg 24i or the attachment rib 24h (compare FIGS. 5 and 9). The top closure 94 extends between the vertical tracks VT and is installed before the panel. A gap between the top panel and the window sill 92 allows the panel to be elevated to clear the bottom slip joint and hence to be installed in the same way as the panels below it. The top panel hangs from the top closure 94 but is not mechanically fastened to it. Instead a structural sealant 96 backed up by a backer rod 98 adhesively fastens the panel to the window assembly.

A wall section two or more panels in horizontal extent and one or more panels in height should be erected by beginning at one end of the section, installing the two vertical tracks VT for one panel or vertical column of panels only and completing each vertical column of one or more panels before moving to the next vertical column. Clearly, the effects of an error in placement of a vertical track are in this way minimized.

Despite the dry seal system, in which vertically adjacent panels are sealed to each other at their horizontal juncture by the horizontal gaskets 55 and the ends of each panel are sealed to the vertical tracks VT by the vertical gaskets 59, water may penetrate the panel wall at "sealed" junctures that are not adequately tight. Also, condensation on the panels and panel supports and tracks is unavoidable in most climates. The present invention provides for draining water horizontally toward the vertical tracks and vertically down the tracks and the panel ends. The frame members 22, 24, 26 of the panel frames are designed such that the base leg portions 22*a*, 24*a*, 26*a*, the L-shaped rear flange portions 22*d*, 24*d*, 26*d* and the edge portions 22*b*, 24*b*, 26*b* form edge-to-edge joints at the mitred corners. Therefore, the recesses 22*e*, 24*e* and 26*e* that open outwardly toward the panel perimeter form horizontal drainage troughs and vertical water drains. Moreover, they form traps adjacent the seals that catch any water that sprays past the seals. The recesses, thusly, provide three functions—one part of a slip joint, a spray shield and a water drainage gutter or conduit. The vertical tracks 56 are intentionally designed with wide rear flange portions 56*a* and with inturned flanges on each edge in order to trap and drain water down the vertical junctures. Water from intrusion or condensation is drained harmlessly to the ends of the panels and thence down to the bottom of each vertical track in a region bounded by the frame rear flange portions 22*d* and the vertical tracks 56. The water ends up on the flashing at a sill or window head and either drains through the drain tubes 70 or simply runs off the flashing at the bottom of the vertical track where there is no caulking.

The "rain screen" principle can be applied with the panel wall system of the invention by omitting the caulking 72 and backer rods 68 at the sills and window heads (FIGS. 6 and 8). Air can enter the open gaps at these locations and equalize the pressures of the air in the air space between the backup wall and the panels and of the air external to the panel wall.

Figure 10:
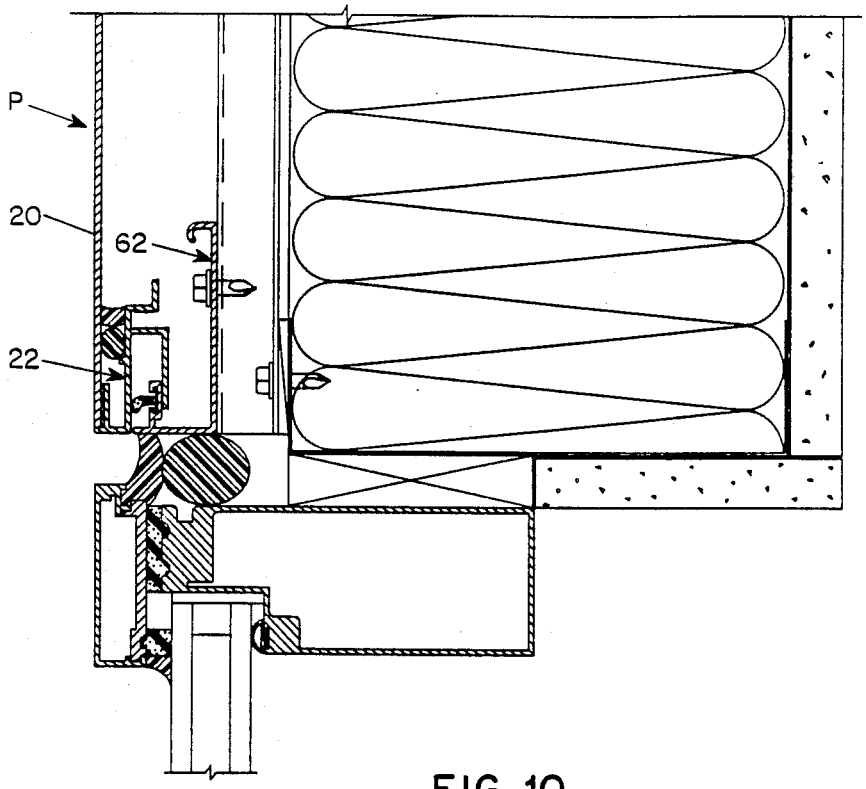

With the above description in mind, the architectural conditions shown in the remaining detail drawings (FIGS. 10 to 21) can readily be understood by those skilled in the art from the drawings and the following descriptions in outline form:

FIG. 10—window jamb, panel wall flush with jamb; panel side frame members 22 form slip joints and seals with vertical track—track is profile 62 (see FIGS. 6 and 8).

Figure 11:
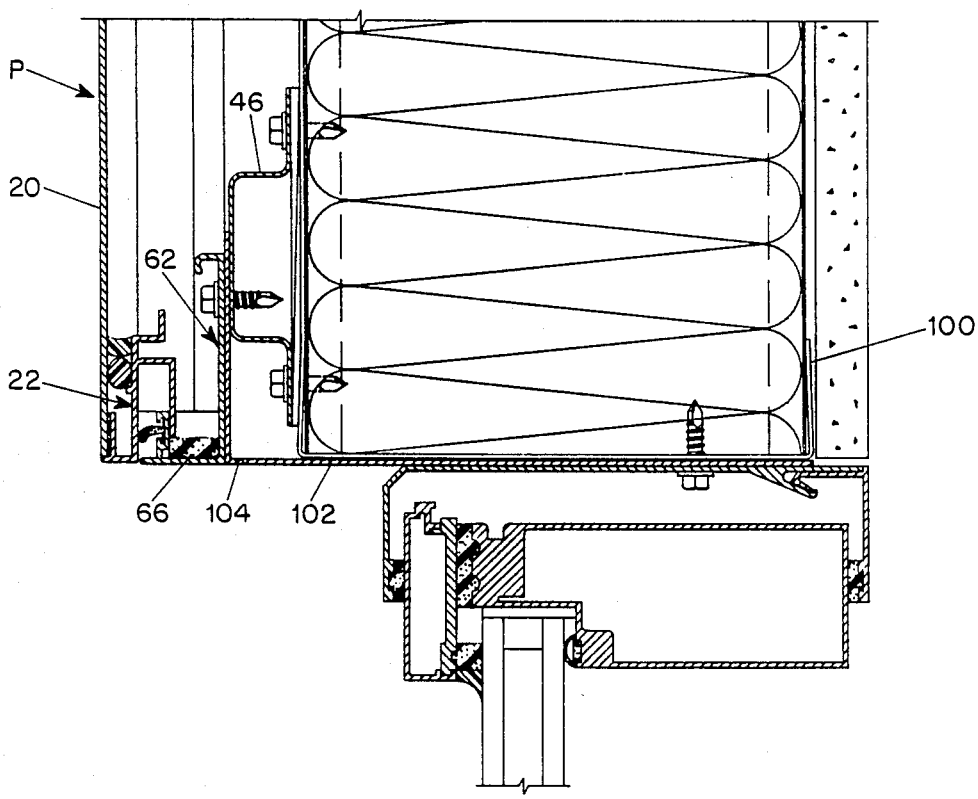

FIG. 11—panel wall at inset window head; backup wall includes light gauge track 100; flashing 102 turned up in front of hat 46; weep holes 104 in flashing; profile 62 forms bottom closure; essentially the same as sill and flush panel at window head—FIGS. 6 and 8.

Figure 12:
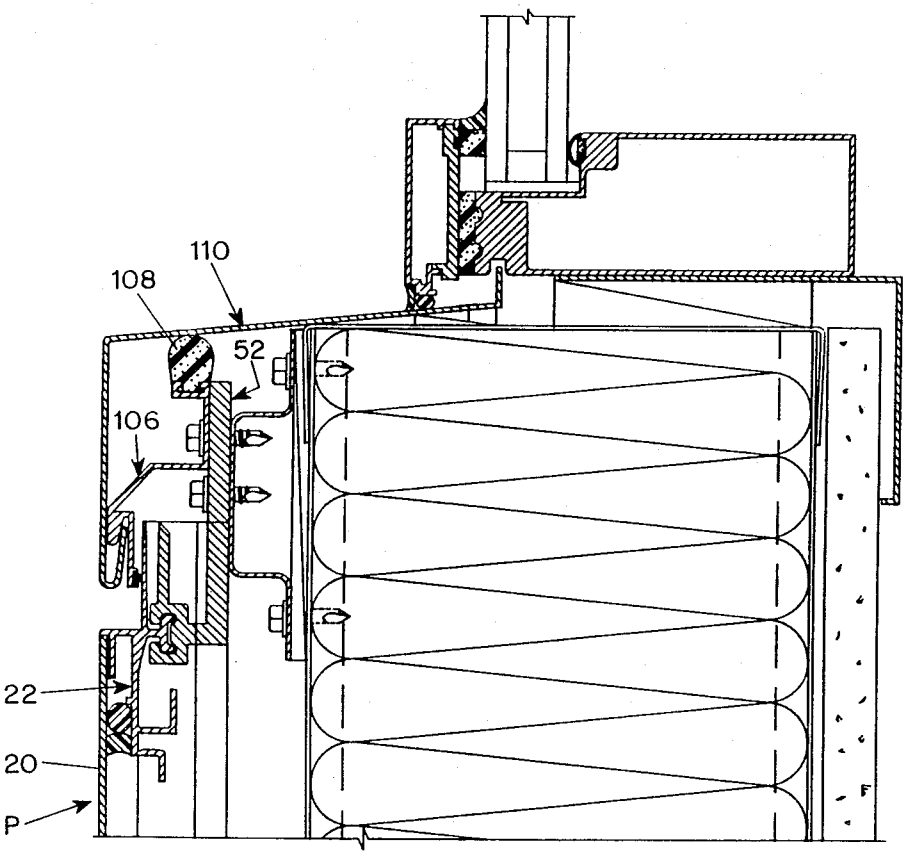

FIG. 12—panel at inset window sill; panel top frame member 24 fastened by clips 52 (see FIG. 5); continuous coping retainer 106 with compression gasket 108 fastened to hat 46; flashing 110 held by coping retainer and carried up and then back under window assembly; panel erected and fastened in the same manner as an intermediate panel in a vertical columnar array (see FIG. 5); coping retainer and flashing installed after panel.

Figure 13:
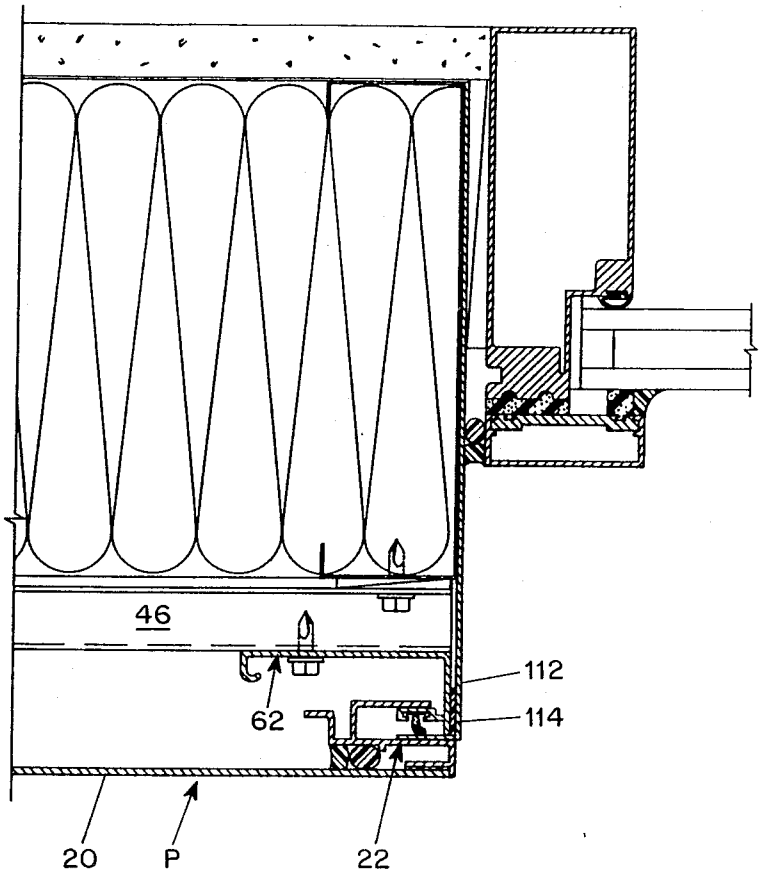

FIG. 13—panel at inset window jamb; vertical track is profile 62 (FIGS. 6 and 8); flashing 112 brought out from jamb and turned into slip joint frame recess 22*d*; double-faced adhesive tape 114 anchors flashing to profile 62.

Figure 14:
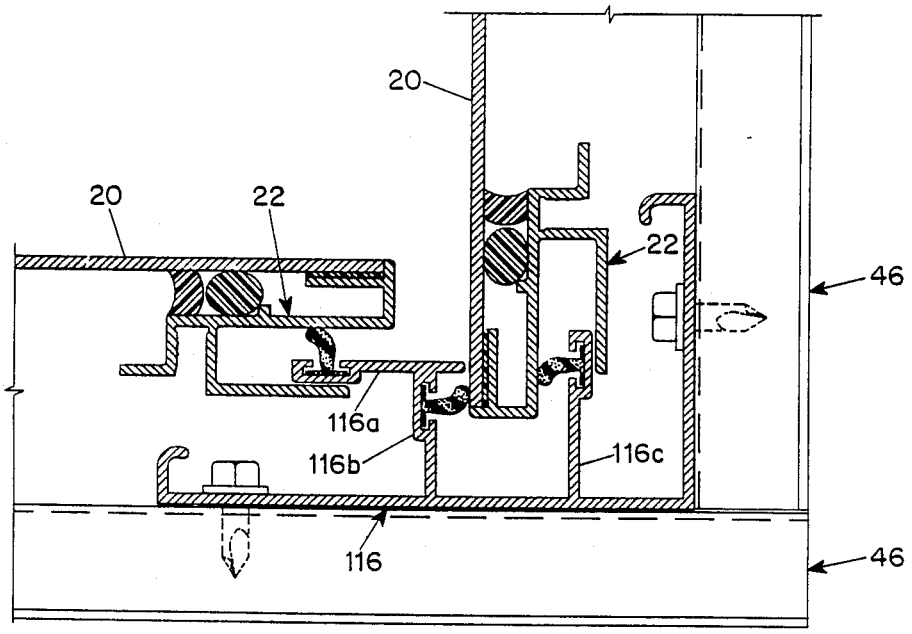

FIG. 14—panel-to-panel juncture at inside corner; continuous vertical track 116 has flange portions 116*a*, 116*b*, 116*c*, each with gasket, forming slip joints and vertical seals with panel ends.

Figure 15:
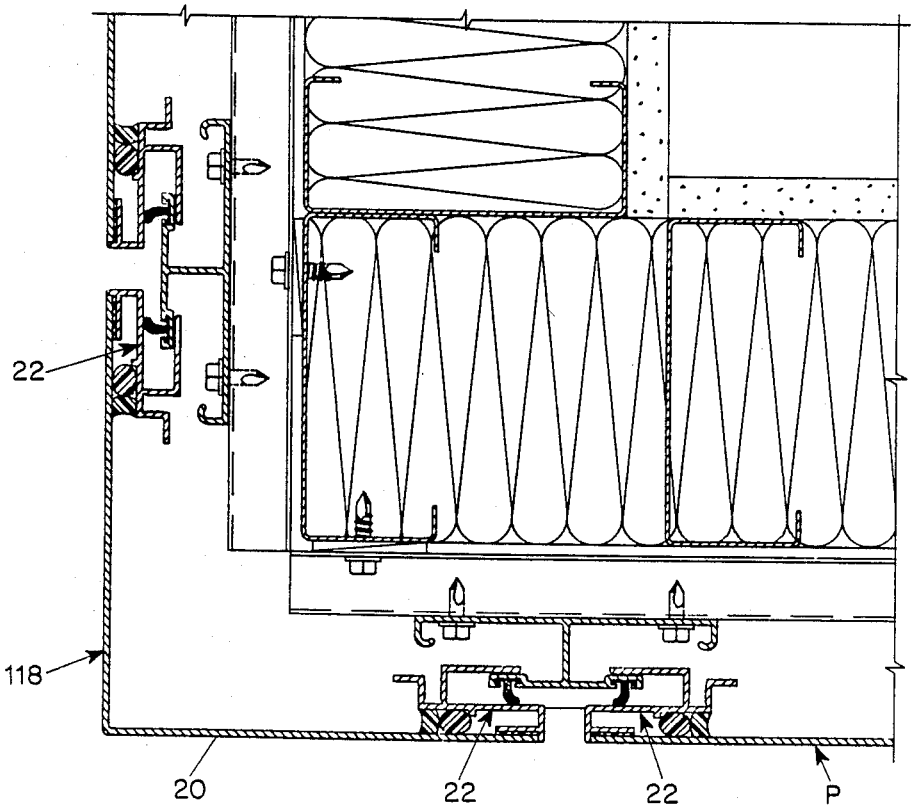

FIG. 15—panel-to-panel juncture at formed outside corner; right-angle panel 118 fabricated in same way as flat panels; panels 118 fastened at tops by clips 52 to hats as in FIG. 5, vertical junctures of panels 118 with flat panels same as FIG. 4; horizontal junctures of right angle panels 118 same as FIG. 5; bottom panel 118 with sill same as FIG. 6.

Figure 16:
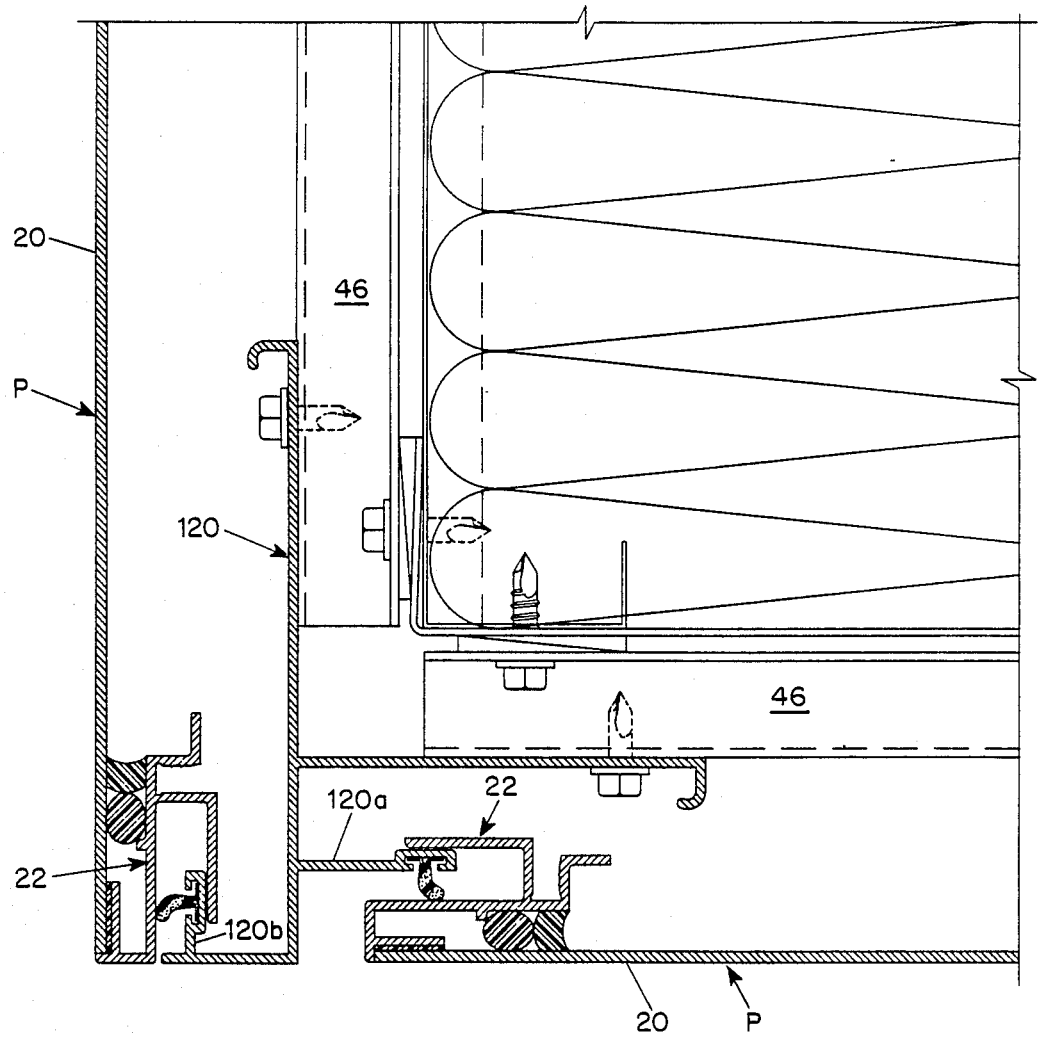

FIG. 16—panel juncture at external corner; continuous right angle vertical track 120 has flange portions 120*a*, 120*b* with gaskets to form slip joints and vertical seals with side frame member recesses 22*d*.

Figure 17:
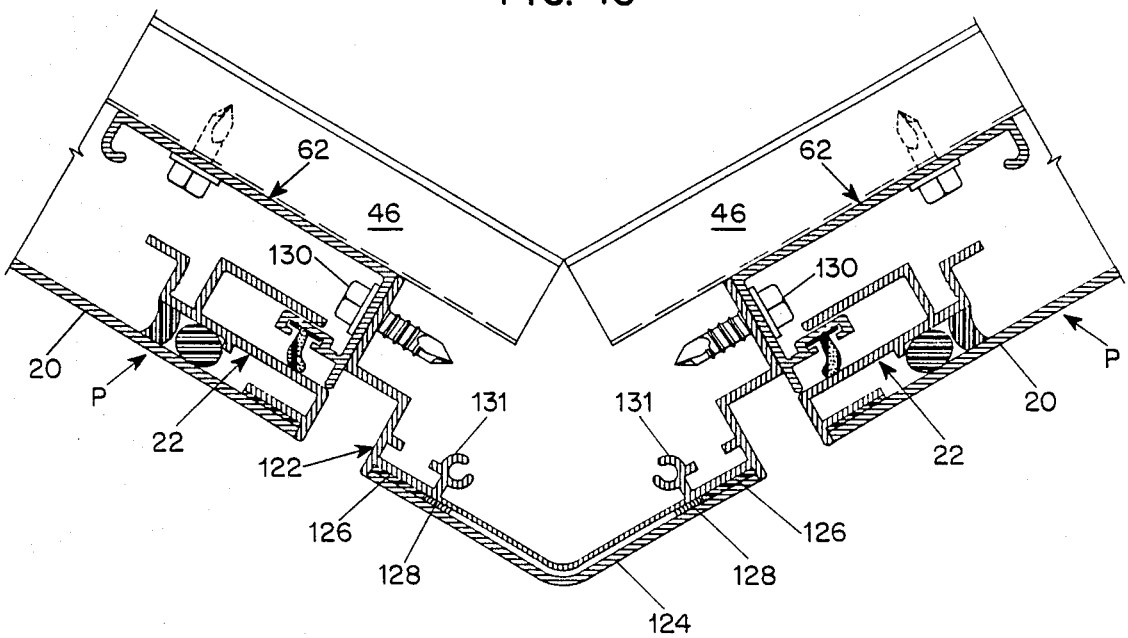

FIG. 17—oblique continuous external corner; special factory assembly of extruded aluminum custom-bent continuous corner 122, facing 124 of sheet material adhesively bonded to corner 122 by double-faced adhesive tape 126 and silicone adhesive 128, and profiles 62 (see FIG. 6) fastened by Teks TM screws 130 to corner 122; wall panels form slip joints with profiles 62; bosses 131 receive alignment pins (not shown) where two or more corner section assemblies are superposed vertically.

Figure 18:
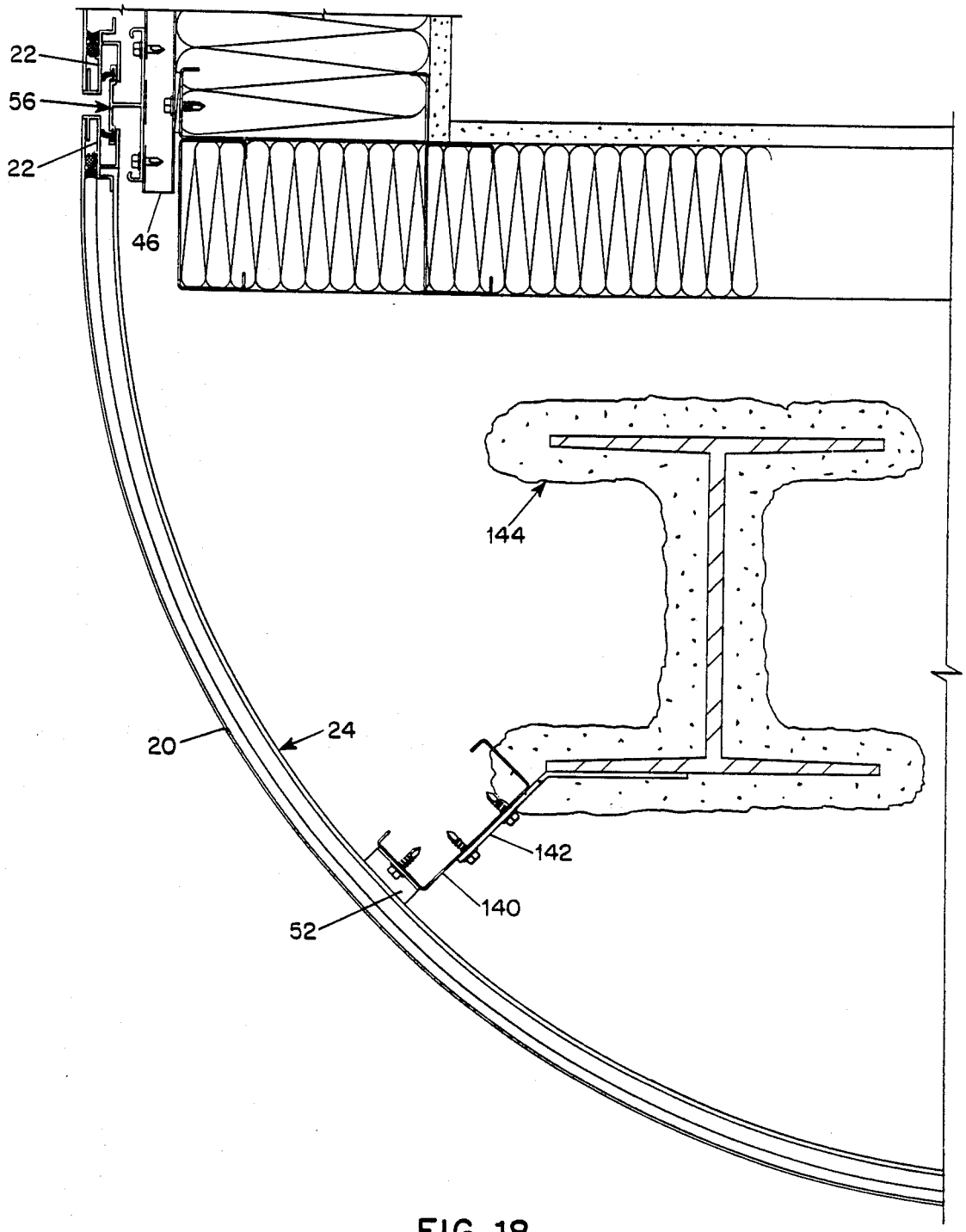

FIG. 18—radius external corner; top and bottom frame members 24 and 26 of panel are bent to desired radius; end members 22 of panel form slip joints with vertical tracks 56 (see FIG. 4); (juncture of panel with other wall is mirror image of the one shown); intermediate part of top frame member fastened by clip 52 (see FIG. 5) to stud 140, which is attached by brackets 142 to fireproofed structural steel column 144.

Figure 19:
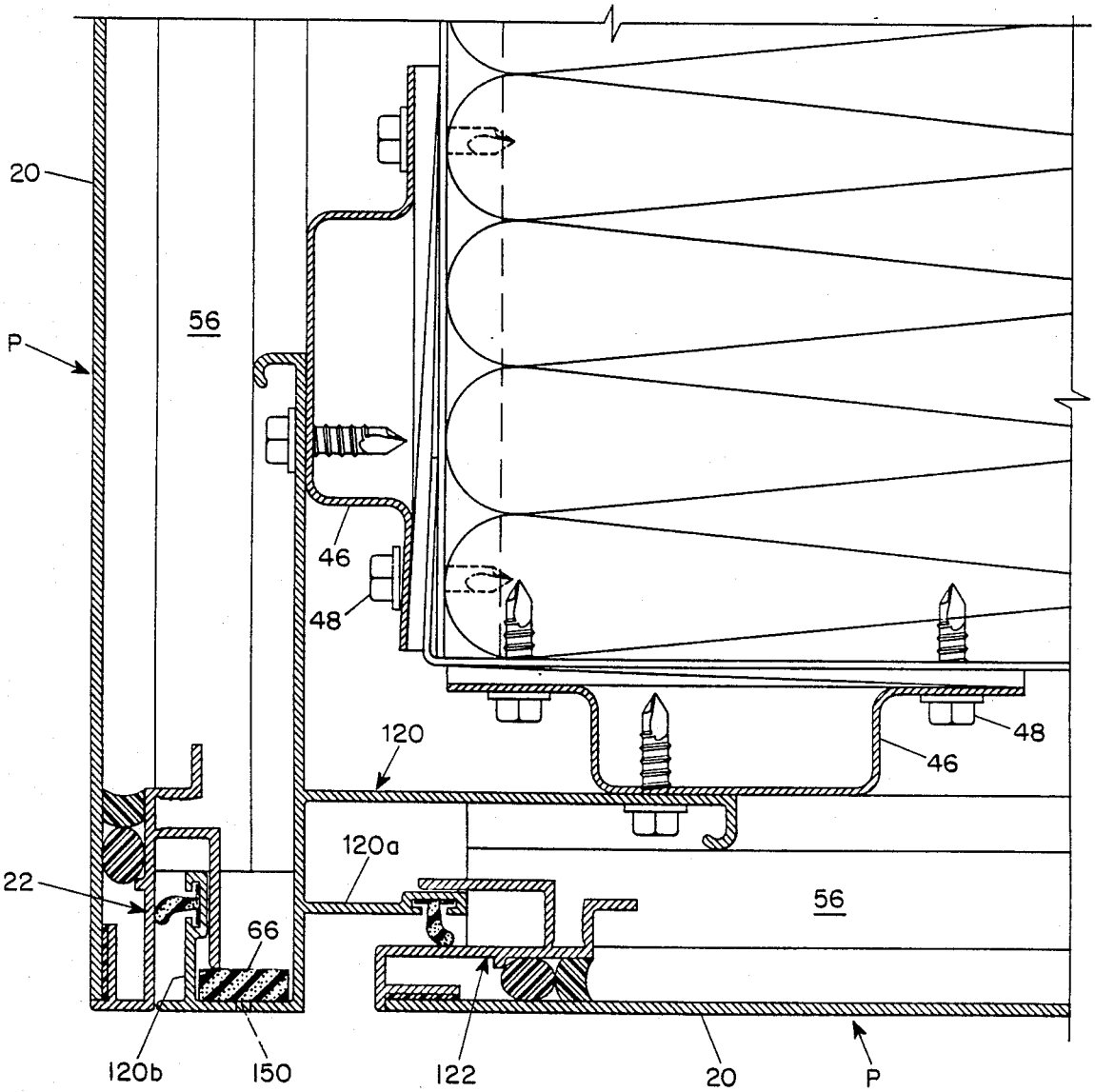

FIG. 19—outside soffit to vertical wall transition; continuous extruded aluminum closure 120 (see FIG. 16) is installed horizontally at bottom of backup wall; panels P form slip joints with flanges 120*a* and 120*b*; bottom frame member of vertical panel is profile 22 (side frame member, see FIG. 4); weep holes 150 drilled in closure 120.

Figure 20:
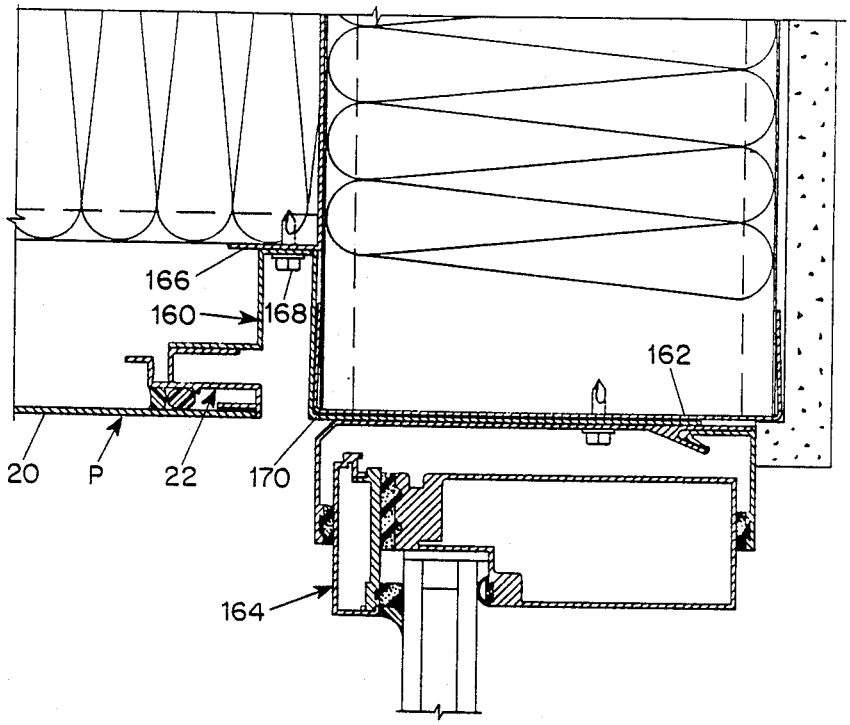

FIG. 20—inside soffit to wall transition; continuous extruded aluminum support 160 factory-welded (or otherwise fastened) to panel frame member 22; light gauge track 162 over window mullion assembly 164; support 160 fastened to structural support 166 by Teks TM screws 168; slip joint at outside end of soffit (FIG. 19) assembled first and then inside end secured; flashing 170 carried into juncture, but juncture need not be caulked.

Figure 21:
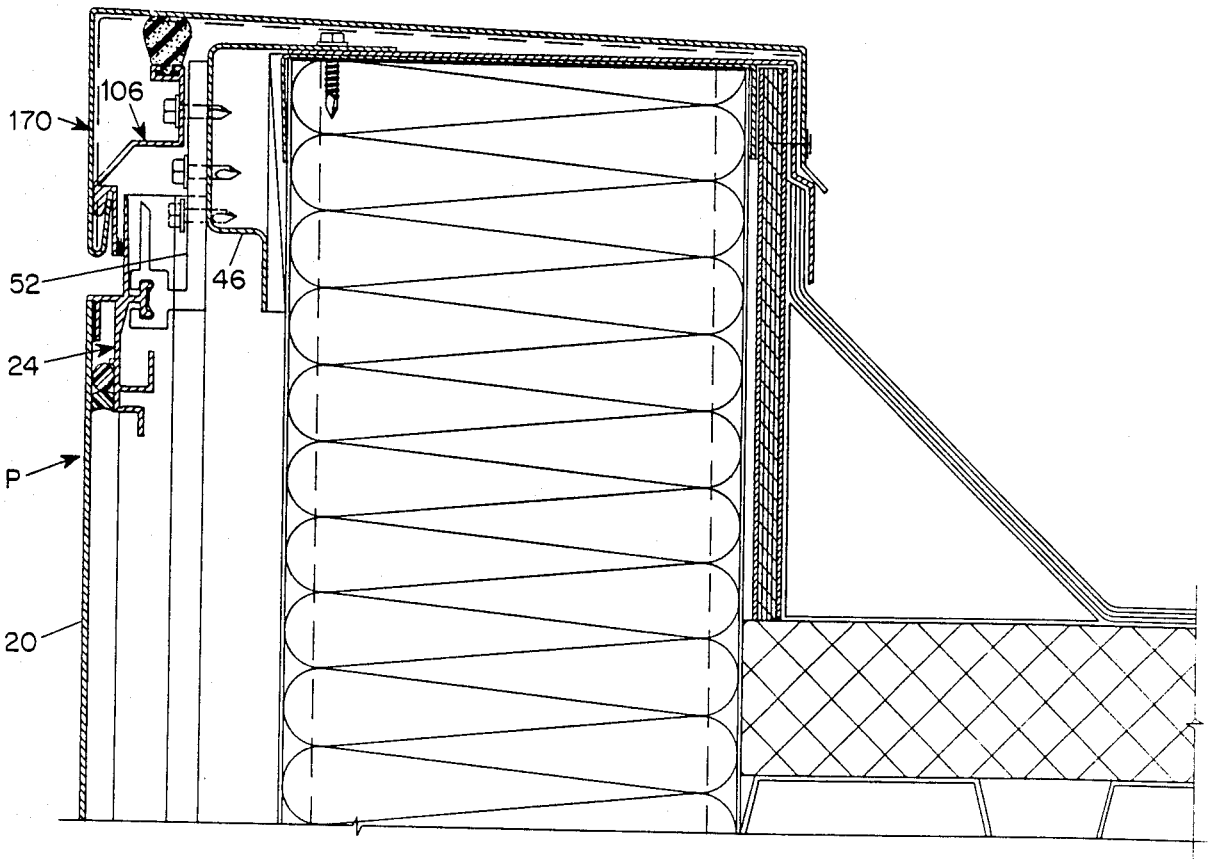

FIG. 21—vertical panel wall to coping transition; coping 170 fitted to coping retainer 106 in same manner as flashing is fitted in FIG. 12; panel attachment is also the same as in FIG. 12.

We claim:

1. A panel wall system composed of a multiplicity of rectangular panels arranged in closely spaced relation in columns and rows such as to define vertical junctures between horizontally adjacent panels and horizontal junctures between vertically adjacent panels and affixed at their upper edges to horizontal support members by mounting clips and joined at each vertical juncture to a vertically continuous vertical track member characterized in that each panel has a peripheral frame composed of a top member, a bottom member and a pair of side members joined at the respective corners and a facing of sheet material adhesively bonded to the frame, in that each of the frame members has a base flange portion having a back surface facing toward the support members and track members, the back surfaces being substantially planar and contiguous, in that a seal is formed along each horizontal juncture by a horizontal gasket on the back surface of the base portion of the bottom frame member of the panel above the juncture that engages an upstanding leg portion on the top frame member of the panel below the juncture, and in that a seal is formed at each vertical juncture by continuous vertical gaskets on the vertical track that engage the back surfaces of the base flanges of the respective side members of the panels on either side of the juncture and also engage portions of back surfaces of the upstanding leg portions, whereby continuous vertical seals are formed along the vertical junctures in intersecting relation with the seals at each horizontal juncture.

2. A panel wall system according to claim 1 and further characterized in that each panel further includes at least one stiffener member extending between and fastened to opposite frame members of the panel and adhesively bonded to the back surface of the facing.

3. A panel wall system according to claim 1 and further characterized in that the horizontal support members for a wall section having a multiplicity of horizontally adjacent panels extend across the vertical junctures and in that the vertical track members are fastened to the horizontal support members.

4. A panel wall system according to claim 3 and further characterized in that the vertical track members have a rear flange portion that extends laterally outwardly on either side of the vertical juncture so as to serve as a barrier to trap any water that penetrates the vertical gaskets and a drainage path for such trapped water to the bottom of a wall section.

5. A panel wall system according to claim 1 and further characterized in that each frame member of each panel has a continuous rear flange portion of generally L-shaped cross-section joined to the base portion of the respective frame member and defining therewith a recess that opens outwardly toward the perimeter of the panel and in that the ends of the flange portions meet edge to edge adjacent the corners of the panels so as to form a continuous water trap at the panel perimeter.

6. A panel wall system according to claim 5 and further characterized in that the recess defined by the rear flange portion of each bottom frame member of each panel above a horizontal juncture forms a slip joint with an upwardly extending front leg on each of the mounting clips by which the panel below that juncture is fastened to the horizontal support.

7. A panel wall system according to claim 5 and further characterized in that the recess defined by the rear flange portion and base flange portion of each side member of each panel adjacent a vertical juncture forms a slip joint with a front flange portion of the vertical track, the front flange portion of the vertical track being received within the recess for transfer of loads orthogonally of the panel to the vertical track.

8. A panel wall system according to claim 7 and further characterized in that the recess of each side member of each panel has a depth in the horizontal direction sufficient to permit the panel to be slided horizontally in one direction toward the vertical track at one side to form one slip joint and leave clearance at the vertical track at the other side for acceptance of the panel and formation of the other slip joint upon sliding the panel in the other direction.

9. A panel wall system according to claim 1 and further characterized in that the top frame member of each panel below a horizontal juncture includes an attachment rib portion that receives the mounting clips, in that the centermost mounting clip is affixed to the attachment rib portion against horizontal movement, and in that all other clips are slidable longitudinally so as to allow differential thermal expansion and contraction of the panel relative to the horizontal support member.

10. A panel wall system according to claim 9 and further characterized in that the clips are segments of an extruded aluminum member of generally J-shaped cross-section having a longer rear leg, a shorter front leg and an undercut slot adjacent the lower edge of the front leg receiving the attachment rib portion of the top frame member.

11. A panel wall system according to claim 10 and further characterized in that each bottom frame member of each panel above a horizontal juncture has a continuous flange of generally L-shaped cross-section defining a recess that opens outwardly toward the bottom edge of the panel and in that the recess forms a slip joint with the front leg of the clip.

12. A panel wall system according to claim 11 and further characterized in that each horizontal support member at a horizontal juncture is located above the juncture so that it can accept fasteners passed through the rear leg of the clip at locations above the upper end of the front leg of the clip and into a horizontal support.

13. A panel wall system according to claim 1 and further characterized in that each panel frame member has a substantially uniform cross-section along its length and includes in cross-section said base leg, the base leg being spaced-apart rearwardly from the facing, lying parallel to the facing and extending inwardly from the perimeter of the facing such as to underlie a portion of the facing, and an L-shaped front flange having a first leg joined to the base leg and forming the edge of the panel and a second leg joined to the first leg and adhesively bonded to a band along the edge of the back surface of the facing.

14. A panel wall system according to claim 13 and further characterized in that the band along the edge of the back surface of the facing is bonded to the second leg of the front flange by a double-faced industrial adhesive tape.

15. A panel wall system according to claim 13 and further characterized in that there is a substantially continuous adhesive bond between the base leg of each frame member and a band along the back surface of the facing spaced apart from the corresponding edge of the facing.

16. A panel wall system according to claim 15 and further characterized in that each panel further includes at least one stiffener member extending between and fastened to opposite frame members of the panel and adhesively bonded to the back surface of the facing.

17. A panel wall system according to claim 15 and further characterized in that the ends of the flange portions meet adjacent the corners of the panels so as to form a continuous water trap at the panel perimeter.

* * * * *